US005509467A

United States Patent [19]

Gibbs

[11] Patent Number: 5,509,467

[45] Date of Patent: Apr. 23, 1996

[54] HEAT EXCHANGER TUBE STRAINER

[75] Inventor: Wesley R. Gibbs, Bronte, Tex.

[73] Assignee: Champion Clam Traps, Inc., Bronte, Tex.

[21] Appl. No.: 267,573

[22] Filed: Jun. 28, 1994

[51] Int. Cl.[6] ..... F28F 19/01

[52] U.S. Cl. ..... 165/119; 210/153; 210/460

[58] Field of Search ..... 165/119; 210/153, 210/460

[56] References Cited

U.S. PATENT DOCUMENTS

| | | | |
|---|---|---|---|
| 231,066 | 8/1880 | Long | 210/315 |
| 317,011 | 5/1885 | Porter | 210/162 |
| 441,497 | 11/1890 | Leland | 165/119 |
| 1,172,938 | 2/1916 | Buxton et al. | 210/153 |
| 2,034,242 | 3/1936 | Mautner | 210/310 |
| 2,121,708 | 6/1938 | Miguel | 165/119 |
| 2,149,065 | 2/1939 | Miguel | 165/119 |
| 2,229,032 | 1/1941 | Ashley | 165/142 |
| 2,774,569 | 12/1956 | Jacobsen | 210/460 X |
| 2,913,995 | 11/1959 | Brenner | 210/460 X |
| 3,039,122 | 6/1962 | Birdsall | 210/460 X |
| 3,850,813 | 11/1974 | Pall et al. | 210/232 |
| 4,133,768 | 1/1979 | Theriot | 210/452 |
| 4,287,067 | 9/1981 | Dyner | 210/487 |
| 4,302,331 | 11/1981 | Condit, Jr. | 210/160 |
| 4,382,465 | 5/1983 | Baron et al. | 165/95 |
| 4,397,349 | 8/1983 | Baron et al. | 165/95 |
| 4,413,675 | 11/1983 | Gano | 165/119 |
| 4,436,633 | 3/1984 | Robinsky et al. | 210/791 |
| 4,489,776 | 12/1984 | Baron | 165/95 |
| 4,517,088 | 5/1985 | Miller | 210/411 |
| 4,590,994 | 5/1986 | Champion | 165/119 |
| 4,617,121 | 10/1986 | Yokoyama | 210/460 X |
| 5,102,537 | 4/1992 | Jones | 210/153 X |
| 5,307,868 | 5/1994 | Barbaud | 165/119 |

OTHER PUBLICATIONS

Champion Marketing & Sales advertising brochure, first published about Jan. 1993.

*Primary Examiner*—Leonard R. Leo
*Attorney, Agent, or Firm*—Richards, Medlock & Andrews

[57] ABSTRACT

A strainer device is provided for use with a water inlet for a heat exchanger tube. The strainer includes a base portion with an anchor for frictionally holding the strainer in the inlet end of the heat exchanger tube, a stop to prevent inward movement of the strainer into the heat exchanger tube past a predetermined position, and a plurality of trap bars or a strainer assembly to prevent the entry of shells and debris of a size greater than a predetermined maximum into the tube inlet while, at the same time, avoiding excessive pressure drops or the accumulation of excessive debris on or adjacent to the strainers.

6 Claims, 3 Drawing Sheets

HEAT EXCHANGER TUBE STRAINER

TECHNICAL FIELD OF THE INVENTION

This invention relates to a strainer device, more specifically, it relates to a device designed to prevent shells and/or debris over a predetermined size from entering the tubes of heat exchanger.

BACKGROUND OF THE INVENTION

Industrial water systems utilizing fresh untreated lake or river water have for some years experienced infestation with an Asiatic clam, Corbicula, and other shellfish to the extent that various portions of the industrial water system become plugged by clam shells. Users of industrial water system users have traditionally utilized one of three methods for dealing with infestation of their industrial water systems by clam shells: mechanical cleaning, chemical treatment, and strainer devices.

Mechanical cleaning involves shutting down the plant, draining water from the heat exchanger, and allowing plant personnel to "rod out" the heat exchanger tubes using a rod or stiff wire. Rodding-out heat exchanger tubes is a time- and labor-intensive task. The rodding process may also damage the interior walls of the tube, leading to increased corrosion and turbulence.

Chemical treatment involves the introduction of a pesticide or other toxic substance into the water stream to control clam infestations. Such chemical treatments have at least two problems. First, chemical treatment is a continuous process, requiring the continued purchase of expensive chemicals for the life of the system. An increasingly important problem involves state and federal water quality regulations which mandate the use of monitoring or detoxification equipment on the water system's discharge to prevent the introduction of dangerous chemicals into the environment. Such equipment may add significantly to the overall cost of the chemical treatment problem.

The use of strainer devices involves the fitting of an individual strainer into or over the end of each heat exchanger tube. The strainer is designed to prevent the entry into the tube of clams, clam shells, or other debris over a predetermined size.

Examples of various different forms of strainer assemblies including some of the general structural and operational features of the instant invention are disclosed in the prior art. However, most of these previously known forms of strainer assemblies are not specifically adapted for use in conjunction with heat exchanger tubes. Another strainer device, which was designed for use with heat exchangers, is described in U.S. Pat. No. 4,590,994 to Champion. While this device represented an improvement over mechanical cleaning or chemical treatments, such devices encounter several problems including pressure drops, a tendency to clog, and cleaning difficulties.

Pressure drops in strainers are caused by a reduction of the water flow path area due to occlusion by the structure of the strainer. Another cause of pressure drops is drag and turbulence resulting from fluid flow around the structure.

A tendency to clog in strainers is caused by unnecessarily small flow passages which accumulate subcritical-sized debris and shells, i.e., of a size that would pass harmlessly through the heat exchanger tube. Another cause of clogging is strainers with structures having numerous features oriented substantially parallel to the front surface of the heat exchanger tube sheet, i.e., perpendicular to the primary direction of water flow into the tubes, thus occluding the flow path and providing opportunities for fibrous debris to accumulate. Yet another cause of clogging is strainers which protrude outward beyond the end of the heat exchanger tubes so far that they provide locations for shells and other debris to become trapped in the cavities formed between adjacent strainer devices.

Cleaning difficulties in strainers are caused by structures with large numbers of flow passages, as accumulations of shells, fibrous material, and debris often require the cleaning of individual passages. Another cause of cleaning difficulty is the accumulation of large shells and debris in the cavities between adjacent strainers.

Other prior art strainer devices, such as the "bullet style" strainer, seek to reduce pressure drops by increasing the size of the openings in the structure; however, the bullet style strainer still includes structural features which may cause turbulence and drag, clog with debris, and it extends outward from the tube sheet far enough to form debris-accumulating cavities between the adjacent strainers. In addition, these designs include ring-shaped stiffeners oriented parallel to the front surface of the tube sheet and perpendicular to the primary direction of water flow into the tubes, thus occluding the flow path and providing opportunities for fibrous debris to accumulate, also tending to clog the water inlet.

A need therefore exists for a strainer device capable of providing the necessary preclusion of unwanted objects, and yet presenting a minimum amount of pressure drop to the fluid stream. A need further exists for a strainer device which contains minimal structural components oriented perpendicularly to the primary direction of water flow into the tubes. A need also exists for a strainer device in which the strainer structure does not protrude so far beyond the end of the heat exchanger tubes as to create debris-accumulating cavities.

Yet another problem encountered in the use of prior art strainers with heat exchangers is their interference with improved leak detection procedures during maintenance. A traditional method of detecting leaks in the tubes of large heat exchangers such as those used in steam power plants is as follows: the heat exchanger is taken out of service and the water drained. Maintenance workers enter the waterbox area of the heat exchanger and remove all strainers from the heat exchanger tube inlets. This is a time-consuming process. Flexible plastic sheeting is then held against the inlet and outlet ends of the heat exchanger tubes. If any of the heat exchanger tubes has a leak, the natural vacuum present on the condenser side of the heat exchanger tubes pulls the plastic sheets tightly against the ends of the leaking heat exchanger tube. The suction of the plastic sheet against the leaking heat exchanger tube can then be visually observed by the maintenance workers, indicating which tube was leaking. An improved method of leak detection involves the use of plastic sheeting only on the outlet end of the heat exchanger, and the use of a layer of soap and water foam, which is sprayed over the inlet ends of the tubes. If a leak was present in one of the heat exchanger tubes, the foam is sucked into the end of that tube, and this can be visually detected by the maintenance personnel. Many prior art strainers must be removed before the foam spray method can be utilized, as it is often impractical to get a simple foam spray of sufficient depth to completely cover the projecting portion of the strainers. In contrast, the use of strainers which project out from the tube sheet a lesser amount than the prior art often eliminates the necessity for maintenance personnel to remove the strainers before using the foam spray method of leak detection. The less the projection of the strainer from the tube sheet, the thinner the layer of foam that is necessary, and the greater the likelihood that the layer of foam can simply be sprayed over the ends of the strainers and that the suction of the foam by leaking tubes can be observed by maintenance personnel.

Yet another problem with prior art strainers is a tendency for the protruding portion of the strainer to be broken or damaged by impact with debris in the water. Strainers which project out from the tube sheet a lesser amount than the prior art exhibit a reduced tendency to break when impacted by debris in the water stream.

One aspect of this invention provides a strainer assembly for use in conjunction with heat exchanger tubes for the purpose of preventing the entrance of Asiatic clams or other debris of predetermined size into the inlet ends of the heat transfer tubes. Another aspect of this invention provides a strainer which may be readily removed and replaced. Still another aspect of this invention provides a strainer construction which may be readily manufactured of different sizes so as to be adaptable for use in conjunction with heat transfer tubes of varying sizes. A further aspect of this invention provides a strainer assembly constructed in a manner whereby the surfaces of the strainer assembly, defining the various surface openings formed therethrough, may be readily cleaned. A final aspect of this invention provides a strainer assembly which will conform to conventional forms of manufacture, be of simple construction, and easy to use so as to provide a device that will be economically feasible, long lasting, and relatively trouble-free in operation. These, together with other aspects and advantages, which will become subsequently apparent, reside in the details of construction and operation, as more fully hereinafter described and claimed, reference being made to the accompanying drawings, forming a part hereof, where in like numerals, refer to like parts throughout.

A need exists, therefore, for provision of means by which infestation of industrial water systems by Asiatic clams be controlled, at least to a reasonable extent, and to this end, the instant invention comprises a strainer assembly which has been found to be highly effective in controlling clam infestation by clams above a predetermined size.

SUMMARY OF THE INVENTION

This invention relates to a novel strainer apparatus for preventing the entry of shells and/or other debris over a predetermined size into the water inlet for a heat exchanger tube.

One embodiment of the invention is comprised of three primary elements: a base, a stop, and at least two trap bars. The base has a wall defining a cylindrical passageway with an axis and has a first end and a second end. The first end of the base has an anchor which fits within the water inlet of the heat exchanger tube and serves to position and hold the strainer in place. Numerous configurations of the anchor are possible. One configuration utilizes a split cylindrical sleeve which is dimensioned to deform resiliently when inserted into the water inlet of the heat exchanger tube and frictionally engage the walls of the tube. Another configuration for the anchor consists of a plurality of longitudinally extending bars dimensioned to deform resiliently when inserted into the water inlet for the heat exchanger tube and frictionally engage the walls of the tube.

A stop is attached to the second end of the base and extends outwardly from the wall of the base in a direction perpendicular to the axis of the passageway. The stop has a first side that faces toward the base. The stop serves to prevent the inward movement of the strainer into the inlet of the heat exchanger tube past a predetermined position. Numerous configurations for the stop are possible. One configuration consists of a continuous circumferential flange around the body of the base. Another configuration utilizes a plurality of circumferential spaced tabs extending outward from the body of the base.

Two or more trap bars are attached to the second end of the base. The trap bars extend from the base in a curved path extending to and joined at a common point located at a distance about 0.2 to about 0.8 diameters of the outside diameter of the base ("base diameter") from the first side of the stop, thereby defining two or more flow openings therethrough. The trap bars prevent shells and debris of greater than a predetermined size from entering into the passageway of the base.

In a further embodiment of the present invention, the trap bars are joined at a common point which is located a distance from the first side of the stop about 0.2 to 0.7 base diameters. In yet another embodiment, the trap bars are joined at a common point located at a distance from the first side of the stop about 0.3 to 0.65 base diameters. In a preferred embodiment, three trap bars are used and these trap bars are joined at a common point located at a distance from the first side of the stop 0.4 to 0.6 base diameters.

In yet another embodiment, the strainer comprises three primary elements: a base, a stop, and a trap assembly. The base has a wall defining a cylindrical passageway, a first and second end, and an anchor as in previous embodiments. The stop member is also configured as in previous embodiments and has a first side facing toward the base.

The trap assembly consists of two or more trap bars, each trap bar extending from the second end of the base, in a curved path lying within a plane containing the axis of the passageway and extending to and joined at a common point located at a distance from the first side of the stop, thereby defining two or more flow openings. Since it consists only of trap bars, each lying within a plane containing the axis of the passageway, this trap assembly minimizes the frontal area of the straining elements which are exposed to the water's flow, thus minimizing pressure drop, turbulence, and the potential of accumulating debris on the bars. As described in previous embodiments of this invention, the common point at which the trap bars are joined may be located at a distance about 0.2 to about 0.8 base diameters from the first side of the stop, or within other intervals previously disclosed.

In yet another embodiment, the strainer comprises three primary elements: a first end and a second end defining a flow axis, and a middle portion located therebetween along said axis. This embodiment does not utilize any elements defining a passageway for the fluid flow. Rather, it utilizes the heat exchanger tube itself to form the passageway.

The first end has an anchor which in its simplest form would comprise a plurality of longitudinally extending bars which would be dimensioned to deform resiliently when inserted within the water inlet of the heat exchanger tube and frictionally engage the walls of the tube to hold the strainer in place. The middle portion of the device has at least one stop extending outwardly perpendicular to the axis of flow. The stop has a first side facing toward the first end of the strainer and serves to prevent the inward movement of the strainer into the heat exchanger tube past a predetermined position. The second end of the strainer has a trap assembly comprising at least two bar members extending from the middle portion in a curved path extending to and joined at a common point located a distance about 0.2 to 0.8 base diameters from the first side of the stop, thereby defining two or more flow channels therebetween. In this embodiment, the trap bar of the trap assembly, the stop, and the longitudinally extending bar of the anchor may all be formed from one appropriately shaped bar. Additional embodiments of this invention are possible in which the common point at which the trap bars are joined is located at a distance 0.2 to 0.7 base diameters from the first side of the stop, or within other intervals previously disclosed.

BRIEF DESCRIPTION OF THE DRAWINGS

For a more complete understanding of the present invention, and for further details and advantages thereof, reference is now made to the following detailed description taken in conjunction with the accompanying drawings, in which.

DETAILED DESCRIPTION

Figure 1B:
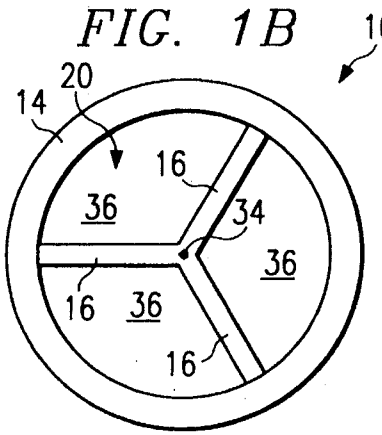
FIG. 1B is a front view of the embodiment of the invention shown in FIG. 1A.

The present invention is a strainer device that overcomes many of the disadvantages found in the prior art. Like numbers in the various drawings refer to like components. Referring to FIG. 1A, a strainer device 10 embodying the present invention is disclosed. Strainer 10 comprises three primary elements: a base 12, a stop 14, and two or more trap bars 16. The base 12 has a wall 18 defining a cylindrical passageway 20 with an axis 22. The base has a first end 24 and a second end 26. The first end 24 has an anchor 28. In this embodiment, the anchor 28 comprises a pair of anchor sleeves 30 separated by sleeve gaps 32. The anchor sleeves 30 are dimensioned to fit within the end of the heat exchanger tube. The sleeve gap 32 allows the anchor sleeves 30 to flex inward and thus maintain frictional contact with the heat exchanger tube walls thus holding the strainer in place.

In this embodiment, the stop 14 comprises a circumferentially extending flange which projects outward from the base wall 18 at the base second end 26. The stop 14 has a first side 15 that faces toward the base 12. The stop 14 prevents the inward movement of the strainer 10 into the end of the heat exchanger tube past a predetermined point.

At least two trap bars 16 extend from the base second end 26 and ahead of flange 14 in a curved path extending to and joined at a common point 34 located at a distance l from the first side 15 of the stop, thereby defining flow openings 36 therethrough. In the embodiment pictured, three trap bars 16 are present. In operation, the trap bars deflect shells and debris which are larger than the flow openings 36 thereby preventing the shells and debris from entering the passageway 20 and proceeding into the heat exchanger tube. Common point 34 is located a distance l from the first side 15 of the stop about 0.2 to about 0.8 diameters of the outside diameter d of the base 12. This location keeps shells and debris far enough from the inlet of the heat exchanger tube to limit their accumulation due to a venturi effect, yet the strainers do not project so far from the tube sheet as to promote the accumulation of debris in cavities between the strainers.

Figure 1A:
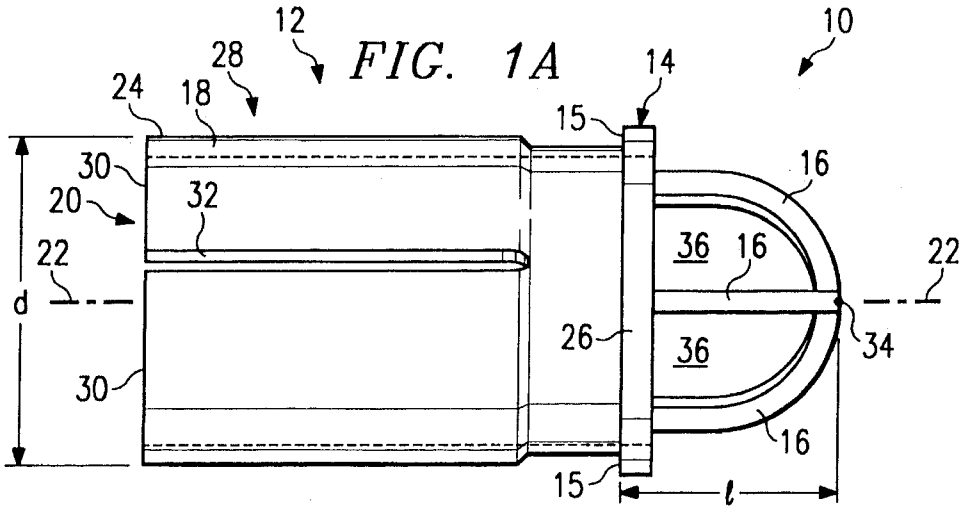
FIG. 1A is a side view of one embodiment of the invention.

FIG. 1B shows a front view of the embodiment of the invention shown in FIG. 1A. This view shows the three trap bars 16 meeting at common point 34 and the three flow openings 36 formed by the trap bars.

In another embodiment of the invention shown in FIGS. 1A and 1B, the trap bars 16 meet at a common point 34 which is located at a distance l from the first side 15 of the stop about 0.2 to 0.7 diameters of the diameter d of the base 12. This location further reduces the size of cavities between adjacent strainers.

In yet another embodiment of the invention, the trap bars 16 meet at a common point 34 which is located at a distance l from the first side 15 of the stop about 0.3 to 0.65 diameters of the diameter d of the base 12. This location provides improved protection against the accumulation of debris against the end of the tubes due to the venturi effect, and further reduces the size of cavities between adjacent strainers.

In a preferred embodiment of the invention shown in FIGS. 1A and 1B, the trap bars 16 meet at a common point 34 which is located at a distance l from the first side 15 of the stop about 0.4 to 0.6 diameters of the diameter d of the base 12. This location provides further protection against the accumulation of debris against the end of the tubes due to the venturi effect, and further reduces the size of cavities between adjacent strainers.

Figure 2B:
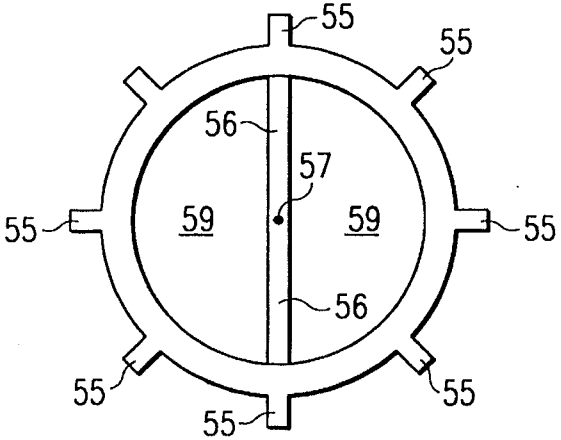
FIG. 2B is a front view of the alternate embodiment of the invention shown in FIG. 2A.
Figure 2A:
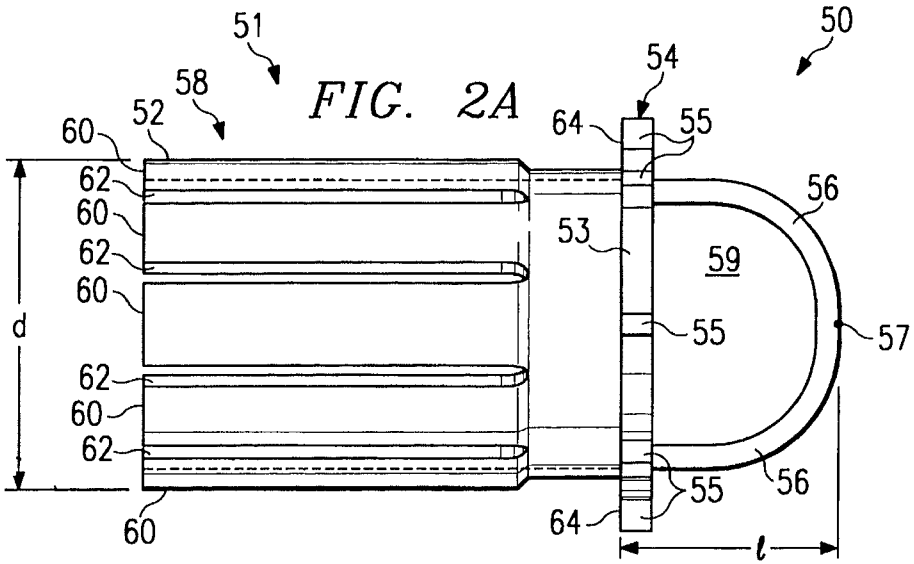
FIG. 2A is a side view of an alternate embodiment of the invention.

FIG. 2A shows an side view of an alternative embodiment of the present invention incorporating a different configuration of anchor, a different configuration of stop, and a different configuration of the trap bars. Strainer 50 is comprised of base 51, stop 54, and two or more trap bars 56. Base 51 has a first end 52 and a second end 53. The first end 52 has an anchor 58 comprised of a plurality of circumferentially spaced, longitudinally extending anchor bars 60. These anchor bars are dimensioned to fit within the heat exchanger tube. The gaps 62 between the anchor bars 60 allow the anchor bars to flex thereby exerting frictional force on the inside of the heat exchanger tube, holding the strainer 50 in place. Other configurations for the anchor would be apparent to one skilled in the art.

In this embodiment, the stop 54 comprises a plurality of circumferentially spaced tabs 55 which project outward from base second end 53. The stop has a first side 64 that faces toward the base 51. Other configurations for the anchor would be apparent to one skilled in the art.

At least two trap bars 56 extend from the base second end 53 in a curved path extending to and joined at a common point 57 located at a distance l from the first side 64 of the stop, thereby defining two or more flow openings 59 therethrough. In the embodiment pictured, two trap bars 56 are present.

In a preferred embodiment of the invention shown in FIGS. 2A and 2B, common point 57 is located at a distance l from the first side 64 of the stop about 0.2 to 0.8 diameters of the diameter d of the base 51.

Figure 3A:
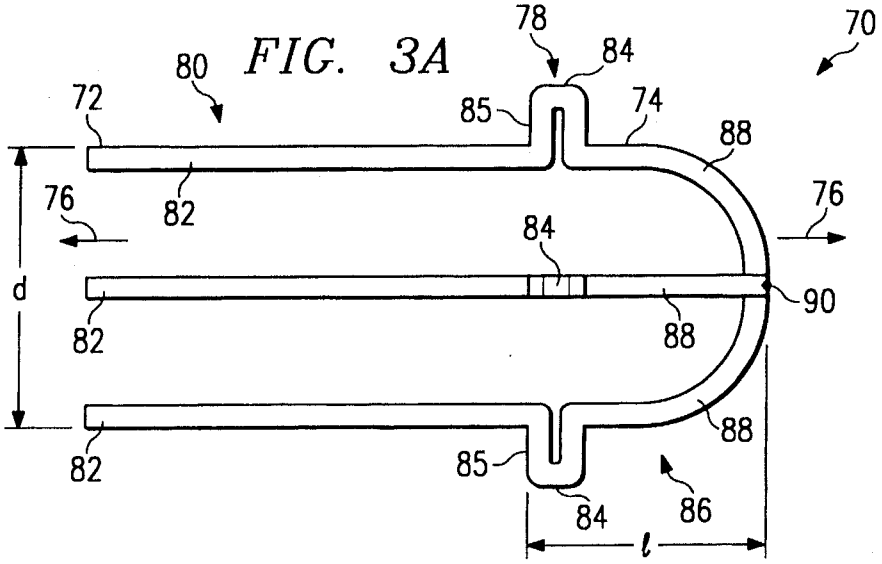
FIG. 3A is an side view of another embodiment of the invention.
Figure 3B:
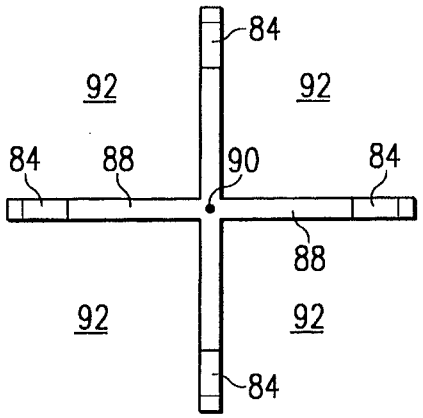
FIG. 3B is a front view of the embodiment of the invention shown in FIG. 3A.

FIG. 3A shows a side view of yet another embodiment of the invention. FIG. 3B shows a front view of the same embodiment. Strainer 70 comprises a first end 72 and a second end 74 defining a flow axis 76 and a middle portion 78 located therebetween along flow axis 76. The first end 72 has an anchor 80 which comprises a plurality of resilient anchor legs 82 extending longitudinally along the flow axis 76. The anchor legs are dimensioned to fit within the heat exchanger tube when flexed and push frictionally against the inside wall of the heat exchanger tube, thus holding the strainer 70 in place. The middle portion 78 of the strainer comprises stops 84 which extend outwardly perpendicular to the flow axis 76. The stops 84 each have a first side 85 that faces toward the first end 72. The stops serve to prevent the inward movement of strainer 70 into the heat exchanger tube past a predetermined point. The stops 84 can be formed from properly shaped extension of the anchor legs 82, or by other methods apparent to one skilled in the art. A trap assembly 86 is located on the second end 74. The trap assembly 86 comprises two or more trap bars 88 extending from the middle portion 78 in a curved path extending to and joined at a common point 90 at a distance l from the first side 85 of the stops, thereby defining a plurality of flow channels 92 therebetween. The trap bars 88 can be formed from properly shaped extensions of the anchor legs 82 or stops 84 or by other methods apparent to one skilled in the art.

In a preferred embodiment of the invention shown in FIGS. 3A and 3B, common point 90 is located at a distance l from the first side 85 of the stop about 0.4 to 0.6 diameters of the diameter d of the heat exchanger tube.

Figure 4:
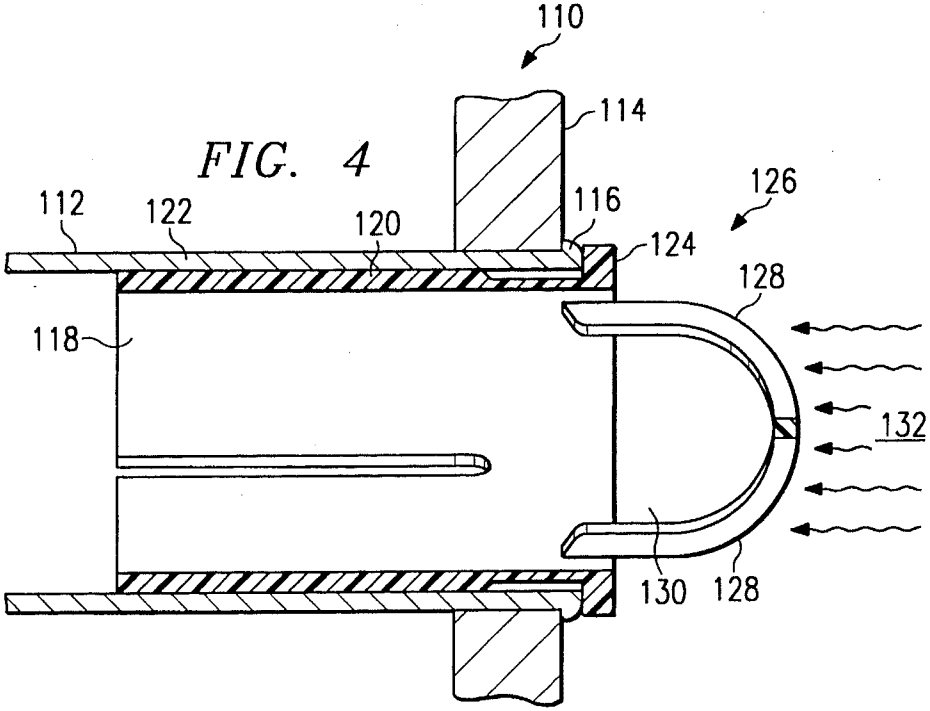
FIG. 4 is a cross-sectional view across the strainer, heat exchanger tube and tube sheet.

FIG. 4 shows a cross-sectional view of a strainer device constructed in accordance with this invention in its operating position in the water inlet end of a heat exchanger tube. The heat exchanger 110 has a heat exchanger tube 112 projecting through heat exchanger end sheet 114. Strainer 118 is fixed into the heat exchanger tube inlet 116. The strainer anchor 120 is in frictional contact with the heat exchanger tube wall 122 thus holding the strainer in place. The stop 124 is in contact with the heat exchanger tube inlet 116, thereby preventing further inward movement of the strainer into the heat exchanger tube. The trap assembly 126 comprising two or more trap bars 128 extends outward from the heat exchanger tube inlet 116 toward the primary direction of water flow 132 and defines flow openings 130. In the embodiment pictured, the complete trap assembly 126 comprises three trap bars 128.

Figure 5:
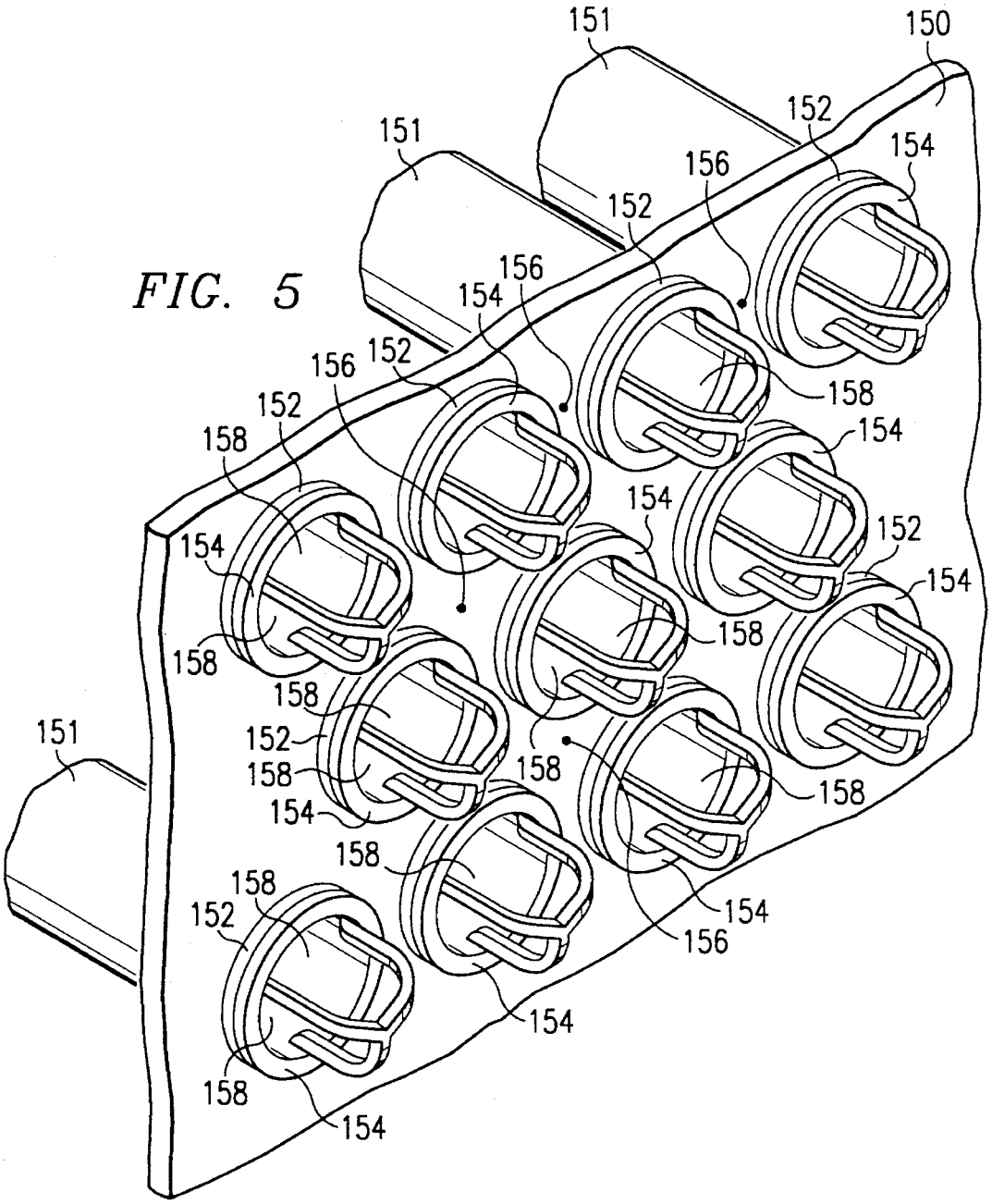
FIG. 5 is a partial perspective view of the tube sheet of the heat exchanger through which the inlet ends of a plurality of heat transfer tubes open and with a plurality of strainer assemblies constructed in accordance with the present invention fixed within the heat transfer tube inlet ends.

FIG. 5 shows a perspective view of a heat exchanger tube sheet 150 through which protrude the inlet ends 152 of a plurality of heat transfer tubes 151, and with a plurality of strainers 154 fixed within the inlet ends 152. The strainers 154 allow the flow of water through the flow openings 158, however, the design of the current invention minimizes the likelihood of debris accumulation in the cavities 156 formed between the strainers 154.

I claim:

1. A strainer for use with a water inlet for a heat exchanger tube, said strainer comprising:

a. a base having a wall defining a cylindrical passageway with an axis, said base having a first end and a second end;

b. said first end of the base having an anchor for inserting into the water inlet of said heat exchanger tube;

c. a stop attached to the second end of the base extending outwardly from said wall perpendicularly to the axis of said passageway, said stop having a first side facing toward said base;

d. at least three trap bars extending from the second end of said base in an inwardly curved path extending to and joined at a common point located at a distance 0.2 to 0.8 diameters of said base from the first side of said stop, thereby defining three or more flow openings therethrough, whereby water flowing into the water inlet of said heat exchanger tube must first pass through at least one of said flow openings; and e. said trap bars having no connection to any other member except at the second end of said base and at said common point.

2. The strainer of claim 1 wherein said trap bars are joined at a common point located at a distance 0.2 to 0.7 diameters of said base from the first side of said stop.

3. The strainer of claim 1 wherein said trap bars are joined at a common point located at a distance 0.3 to 0.65 diameters of said base from the first side of said stop.

4. The strainer of claim 1 wherein said trap bars are joined at a common point located at a distance 0.4 to 0.6 diameters of said base from the first side of said stop.

5. The strainer of claim 4 having three said trap bars.

6. The strainer of claim 5, wherein each of said trap bars has a rectangular cross section and follows an arcuate path lying in a plane containing said axis.

* * * * *